US008816229B2

(12) United States Patent
Seeh

(10) Patent No.: US 8,816,229 B2
(45) Date of Patent: Aug. 26, 2014

(54) ELECTRICAL SWITCH

(75) Inventor: Erich Seeh, Neuhausen (DE)

(73) Assignee: TRW Automotive Electronics & Components GmbH, Radolfzell (DE)

( * ) Notice: Subject to any disclaimer, the term of this patent is extended or adjusted under 35 U.S.C. 154(b) by 75 days.

(21) Appl. No.: 13/503,383

(22) PCT Filed: Nov. 25, 2010

(86) PCT No.: PCT/EP2010/007169
§ 371 (c)(1),
(2), (4) Date: May 10, 2012

(87) PCT Pub. No.: WO2011/063964
PCT Pub. Date: Jun. 3, 2011

(65) Prior Publication Data

US 2013/0112538 A1 May 9, 2013

(30) Foreign Application Priority Data

Nov. 25, 2009 (DE) ..... 10 2009 055 669

(51) Int. Cl.
*H01H 23/00* (2006.01)

(52) U.S. Cl.
USPC ..... 200/401; 200/339; 200/553

(58) Field of Classification Search
USPC ..... 200/401
See application file for complete search history.

(56) References Cited

U.S. PATENT DOCUMENTS

| | | | | |
|---|---|---|---|---|
| 5,357,071 | A * | 10/1994 | Hanaki | 200/557 |
| 5,753,874 | A | 5/1998 | Kossakowski | |
| 6,737,592 | B1 | 5/2004 | Hoang et al. | |
| 6,914,201 | B2 | 7/2005 | Van Vooren et al. | |
| 6,914,202 | B2 * | 7/2005 | Sugimoto et al. | 200/1 B |
| 7,554,049 | B2 | 6/2009 | Wada et al. | |
| 7,834,286 | B2 | 11/2010 | Michel et al. | |
| 7,989,724 | B2 | 8/2011 | Altmann et al. | |
| 8,138,432 | B2 * | 3/2012 | Larsen et al. | 200/5 R |
| 2009/0107820 | A1 * | 4/2009 | Michel et al. | 200/339 |
| 2009/0114517 | A1 | 5/2009 | Altmann et al. | |

FOREIGN PATENT DOCUMENTS

| | | |
|---|---|---|
| CN | 101430983 | 5/2009 |
| DE | 31 29 210 | 2/1983 |
| DE | 3433604 | 3/1986 |
| DE | 196 00 657 | 4/1997 |
| DE | 10206777 | 9/2003 |
| DE | 102007052655 | 5/2009 |
| EP | 2053623 | 4/2009 |
| JP | 2008293673 | 12/2008 |

* cited by examiner

*Primary Examiner* — Kyung Lee
(74) *Attorney, Agent, or Firm* — Tarolli, Sundheim, Covell & Tummino LLP

(57) ABSTRACT

An electric switch, in particular a rocker or toggle switch, includes a manually operable actuating part (12) that is mounted for rotary or swiveling motion and is deflectable from a neutral position to an actuating position. The electric switch further includes an electric switching member (16) that is adapted to be actuated mechanically, and an actuating member (22) that acts upon the switching member (16). The actuating member (22) is coupled to the actuating part (12) and to the switching member (16) such that a rotary or swiveling motion of the actuating part (12) from the neutral position to the actuating position is transformed into a substantially linear motion of the actuating member (22).

13 Claims, 3 Drawing Sheets

ELECTRICAL SWITCH

RELATED APPLICATIONS

This application corresponds to PCT/EP2010/007169, filed Nov. 25, 2010, which claims the benefit of German Application No. 10 2009 055 669.9, filed Nov. 25, 2009, the subject matter, of which are incorporated herein by reference in their entirety.

BACKGROUND OF THE INVENTION

The present invention relates to an electric switch, in particular a rocker or toggle switch.

Rocker switches which are made use of in motor vehicles, in particular in steering wheels, are in most cases subject to severe limitations as to installation space. A flat design of rocker switches is possible when micro-switching members or snap disks are used which can be directly actuated by a rocking movement of an actuating part. These components, however, are comparatively expensive, so that such rocker switches can not be produced at low cost.

Other rocker switch concepts are also known, which allow the use of lower-cost switching mats. In DE 102 06 777 A1, for example, a generic switch having a swivel-mounted switch rocker is shown. Starting from its neutral position, the switch rocker is adapted to be swiveled, with respect to the neutral position, to opposite functional positions in which one or more respective electric switch members are actuated by the switch rocker. The "oblique" actuation of the switch members provided for in this concept is, however, accompanied by a considerable loss of haptics.

SUMMARY OF THE INVENTION

The object of the invention is to provide a low-cost and reliable electric switch which is suitable for the automotive field and has a pleasant haptics during the switching process, and which can be implemented with a small overall height.

This object is achieved by an electric switch having the features of claim 1. Advantageous configurations of the electric switch according to the invention are specified in the dependent claims.

The electric switch according to the invention, in particular a rocker or toggle switch, includes a manually operable actuating part that is mounted for rotary or swiveling motion and is deflectable from a neutral position to an actuating position. The electric switch further includes an electric switching member that is adapted to be actuated mechanically, and an actuating member that acts upon the switching member. The actuating member is coupled to the actuating part and to the switching member such that a rotary or swiveling motion of the actuating part from the neutral position to the actuating position is transformed into a substantially linear motion of the actuating member.

The structure according to the invention allows the use of a switching mat as the electric switching member, so that the switch as a whole may be designed to be very flat. The special coupling of the actuating part, which transforms the rotary or swiveling motion of the actuating part into a linear motion of the actuating member, allows a perpendicular action of the actuating member on the switching mat. This ensures a reliable and haptically pleasant actuation of the switching mat.

In a preferred embodiment of the invention, the actuating member is rotatably coupled to the actuating part. This gives the actuating member an additional degree of freedom in relation to the actuating part, so that a tilting of the actuating member as otherwise caused by the rotary or swiveling motion of the actuating part from the preferred linear switching direction of the switching member can be compensated for.

One way of implementing the rotational coupling of the actuating member to the actuating part in a simple manner resides in mounting at least one pin portion of the actuating member for rotation in a preferably keyhole-shaped or U-shaped seat of the actuating part.

An undesirable evasion of the actuating member upon actuation of the switch can be avoided in that the rotational coupling of the actuating member to the actuating part is designed such that the actuating member is not permitted to make a linear motion in a direction perpendicular to the axis of rotation of the actuating member.

For the actuating member, adapted for (limited) movement, to maintain a defined orientation relative to the switching member during the switching process, the actuating member preferably includes a contact portion which, at least in the actuating position, rests on a raised portion of the switching member.

Advantageously, according to a continuation of the above aspect, a stable neutral position of the switch may be predefined in that (also) in the neutral position, the contact portion rests on the raised portion of the switching member in a prestressed condition (of course without triggering a switching process thereby).

According to a further development of the actuating member, the contact portion thereof includes a rim which engages around the raised portion of the switching member, preferably with a clearance. The form-fitting connection, reached thereby to a greater or lesser extent, between the actuating member and the switching member additionally secures the desired positioning of the actuating member relative to the switching member. A certain clearance between the rim of the actuating member and the raised portion of the switching member allows a principle-related minimum translational shifting of the actuating member relative to the switching member during the switching process without a haptically disturbing resistance.

The switch concept according to the invention may be extended to a rocker switch having two actuating positions, which are reached by swiveling or turning a two-armed actuating member in opposite rotational or swiveling directions (rocker switch). For this purpose, on opposite sides of a hinge pin or swivel pin about which the actuating part is deflectable, two actuating members are coupled to the actuating part and each is coupled to a respective electric switching member arranged on either side of the pin such that rotary or swiveling motions of the actuating part from the neutral position into opposite directions are each transformed into a substantially linear motion of the actuating member.

BRIEF DESCRIPTION OF THE DRAWINGS

Further features and advantages of the invention will be apparent from the description below and from the accompanying drawings, to which reference is made and in which.

DESCRIPTION OF EXEMPLARY EMBODIMENTS

Figure 1:
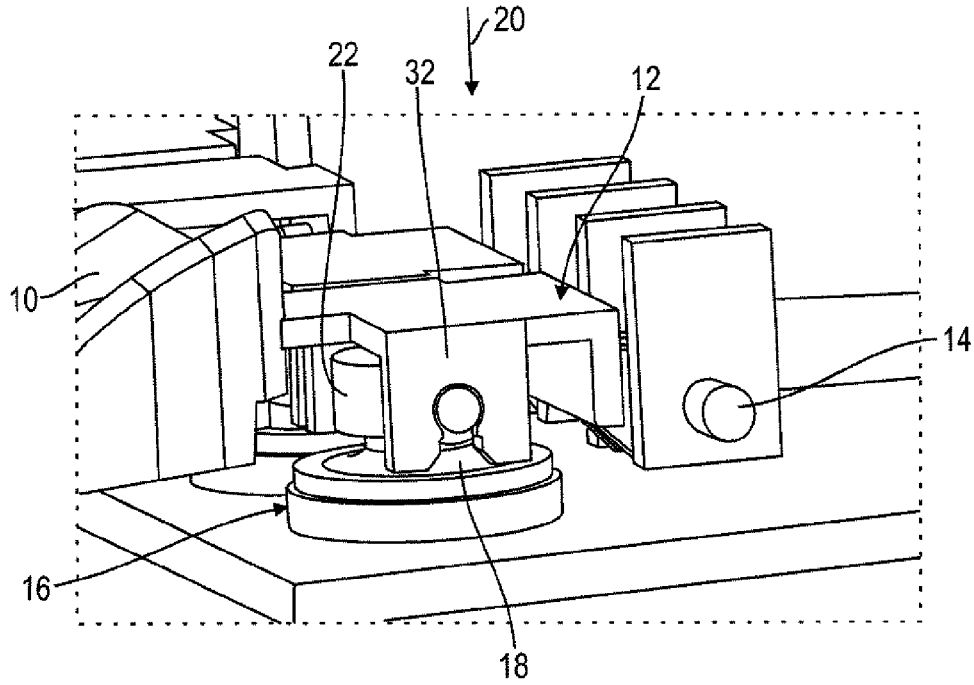
FIG. 1—shows a perspective view of a switch according to a first embodiment of the invention, in the non-actuated state.
Figure 2:
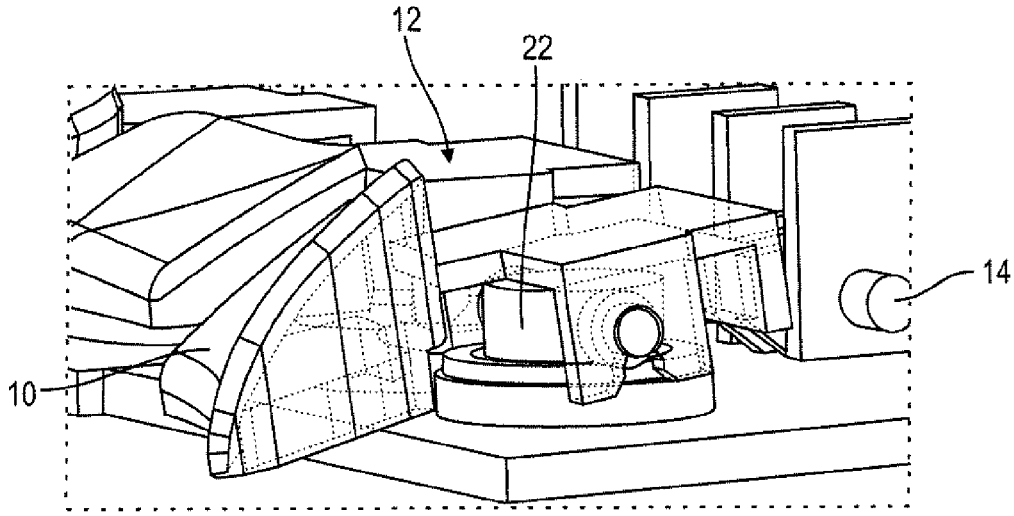
FIG. 2—shows the switch from FIG. 1 in the actuated state in a perspective half section.

FIGS. 1 and 2 show a first embodiment of an electric rocker switch having a manually operable pushbutton 10. The pushbutton 10 is part of an actuating part 12 of the switch, the actuating part 12 being deflectable from a neutral position (FIG. 1) to an actuating position (FIG. 2). To this end, the actuating part 12 is mounted on a component that is stationary in relation to the motion of the actuating part 12, for rotary or swiveling motion about a hinge pin or swivel pin 14.

Likewise fitted on a component that is stationary in relation to the motion of the actuating part 12 is an electric switching member 16 in the form of a switching mat (rubber switching mat). The switching member 16 has a raised portion 18. By depressing the raised portion 18 in a switching direction 20, an electrical switching process is triggered. The tactile feedback that is perceived as a snapping is characteristic of a switching mat here.

The switch further comprises an actuating member 22 which acts upon the switching member 16 and is mechanically coupled, on the one hand, to the actuating part 12 and, on the other hand, to the switching member 16, more precisely to the raised portion 18 thereof. The special feature of this coupling consists in that a rotary or swiveling motion of the actuating part 12 from the neutral position to the actuating position is transformed into a substantially linear motion of the actuating member 22, as will be discussed in detail below.

Figure 3:
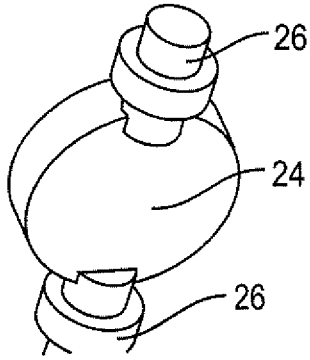
FIG. 3—shows a perspective view of an actuating member for a switch according to the invention, according to a first variant.
Figure 4:
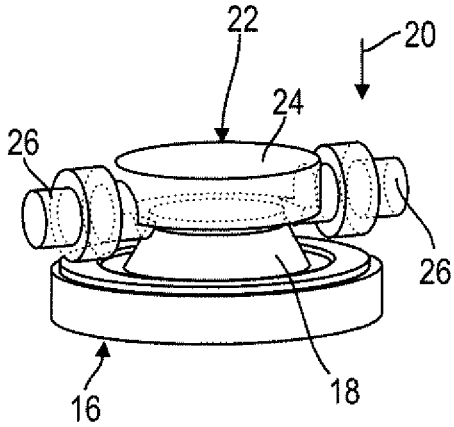
FIG. 4—shows the actuating member from FIG. 3 in cooperation with a switching member.

The actuating member 22 shown separately in FIG. 3 includes a central contact portion 24, from which two pin portions 26 extend in opposite directions. As is best seen in FIG. 4, the actuating member 22 rests by its contact portion 24 on the raised portion 18 of the switching member 16. Just like the pin portions 26, the bearing surfaces of the contact portion 24 and of the raised portion 18 are oriented perpendicularly to the switching direction 20.

Figure 5:
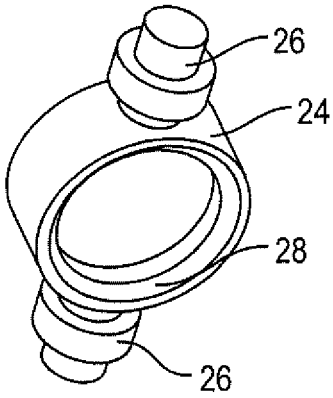
FIG. 5—shows a perspective view of an actuating member for a switch according to the invention, according to a second variant.

FIG. 5 illustrates an alternative variant of the actuating member 22. The actuating member 22 includes a rim 28 extending perpendicularly from the bearing surface and engaging around the raised portion 18 of the switching member 16 in the neutral position of the switch. A certain clearance is provided between the rim 28 and the raised portion 18.

The pin portions 26 of the actuating member 22 are mounted for rotation in seats 30 of the actuating part 12. The seats 30 are formed in the shape of a keyhole, in wall sections 32 of the actuating part 12 which extend perpendicularly to the pin portions 26. The keyhole shape has the advantage that the pin portions 26 may be simply pressed into the seats 30 perpendicularly to their direction of extent. Other shapes such as, e.g., a U-shape or a simple bore hole are however also possible. In any case, the actuating member 22 is not permitted to make any linear motion towards the pin portions 26 and, above all, any linear motion in a direction perpendicular to the direction of the pin portions 26. Therefore, the actuating member 22 is mounted in the actuating part 12 for rotation only about an axis that is parallel to the hinge pin or swivel pin 14.

The functioning of the switch will now be explained below. In the stable neutral position shown in FIG. 1, the actuating member 22 rests on the switching member 16 with a defined prestress. The prestress is dimensioned such that no switching process is triggered, i.e. the raised portion 18 of the switching member 16 is depressed to a small degree or not at all.

A manual actuation of the pushbutton 10 will cause the actuating part 12 to be deflected (FIG. 2) by performing a rotary or swiveling motion about the pin 14. The actuating member 22 mounted remote from the pin 14 is not tilted in the process, but retains its orientation relative to the switching member 16 and linearly depresses the raised portion 18 of the switching member 16 in the switching direction 20, that is, perpendicularly to the bearing surfaces, so that a switching process is triggered with an optimum force introduction and a tactile feedback for the user.

The actuating member 22 retains its orientation because it is mounted in the actuating part 12 for rotation about an axis that is parallel to the hinge pin or swivel pin 14 of the actuating part 12 and can therefore be held in this orientation by the raised portion 18 of the switching member 16, in particular by the bearing surface thereof.

Figure 6:
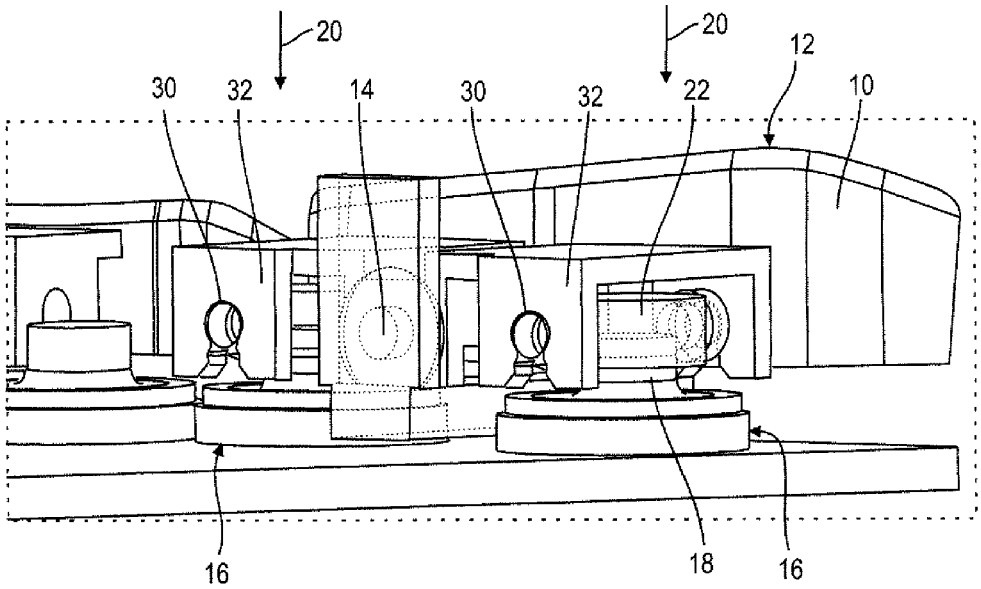
FIG. 6—shows a perspective view of a switch according to a second embodiment of the invention, in the non-actuated state.
Figure 7:
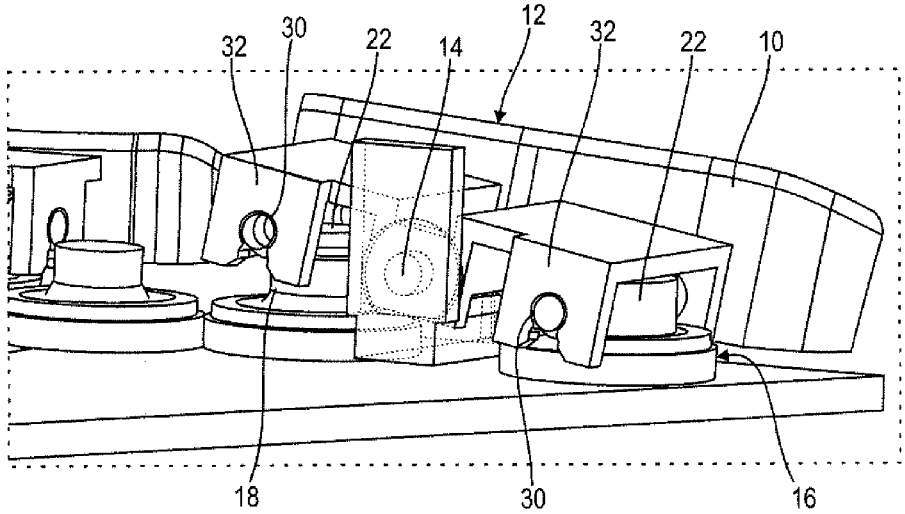
FIG. 7—shows the switch from FIG. 6 in an actuated state.

FIGS. 6 and 7 show a second embodiment of a rocker switch. Proceeding from a neutral position (FIG. 6), this switch can be deflected into two actuating positions. The second embodiment of the switch is based on the same principle as the first embodiment and differs from it essentially in that provision is made not only for one actuating member 22 and one switching member 16 cooperating therewith, but for two each. The switching members 16 are arranged on opposite sides of the hinge or swivel pin 14. Accordingly, the actuating members 22 in the actuating part 12 are also mounted for rotation on opposite sides of the hinge or swivel pin 14.

The structure of the switch thus corresponds on both sides to that described above, so that in this respect reference may be made to the above explanations, also as regards the basic functioning. Depending on the rotational or swiveling direction of the actuating part 12 about the hinge pin or swivel pin 14, the one or the other switching member 16 will be actuated here (FIG. 7).

The switches described are suitable in particular as rocker switches for motor vehicle steering wheels. However, other applications are also conceivable in which importance is attached to a small overall height of the switches and a pleasant haptics during the switching process.

LIST OF REFERENCE NUMBERS

10 pushbutton
12 actuating part
14 hinge pin/swivel pin of the actuating part
16 electric switching member
18 raised portion
20 switching direction
22 actuating member
24 contact portion
26 pin portions
28 rim
30 seat
32 wall section

The invention claimed is:

1. An electric switch, in particular a rocker or toggle switch, comprising a manually operable actuating part (12) that is mounted for rotary or swiveling motion and is deflectable from a neutral position to an actuating position, an electric switching member (16) that is adapted to be actuated mechanically, and an actuating member (22) that acts upon the switching member (16), the actuating member (22) being permanently coupled to the actuating part (12) and to the switching member (16) such that a rotary or swiveling motion of the actuating part (12) from the neutral position to the actuating position is transformed into a substantially linear motion of the actuating member (22).

2. The electric switch according to claim 1, wherein the actuating member (22) is rotatably coupled to the actuating part (12).

3. The electric switch according to claim 2, wherein at least one pin portion (26) of the actuating member (22) is mounted for rotation in a preferably keyhole-shaped or U-shaped seat (30) of the actuating part (12).

4. The electric switch according to claim 2, wherein the rotational coupling of the actuating member (22) to the actuating part (12) is designed such that the actuating member (22) is not permitted to make a linear motion in a direction perpendicular to the axis of rotation of the actuating member (22) relative to the actuating part (12).

5. The electric switch according to claim 1, wherein the actuating member (22) includes a contact portion (24) which, at least in the actuating position, rests on a raised portion (18) of the switching member (16).

6. The electric switch according to claim 5, wherein in the neutral position, the contact portion (24) rests on the raised portion (18) of the switching member (16) in a prestressed condition.

7. The electric switch according to claim 5, wherein the contact portion (24) includes a rim (28) which engages around the raised portion (18) of the switching member (16), preferably with a clearance.

8. The electric switch according to claim 1, wherein on opposite sides of a hinge pin or swivel pin (14) about which the actuating part (12) is deflectable, two actuating members (22) are coupled to the actuating part (12) and each is coupled to a respective electric switching member (16) arranged on either side of the pin (14) such that rotary or swiveling motions of the actuating part (12) from the neutral position into opposite directions are each transformed into a substantially linear motion of the actuating member (22).

9. An electric switch, comprising:

a manually operable actuating part rotatably mounted to a component, the actuating part being rotatable relative to the component from a neutral position to an actuating position; and an actuating member engaging the actuating part at all times, the actuating member being configured to actuate an electric switching member connected to the component, the actuating member being configured to move substantially linearly relative to the component in response to rotation of the actuating part relative to the component from the neutral position to the actuating position.

10. The electric switch according to claim 9, wherein the actuating member actuates the electric switching member in response to the substantially linear movement relative to the component.

11. The electric switch according to claim 9, wherein the actuating member is fixedly mounted to the actuating part by pressing a pair of pin portions into corresponding seats of the actuating part.

12. The electric switch according to claim 9, wherein the actuating member is rotatably connected to the actuating part, the actuating member rotating relative to the actuating part as the actuating part moves between the neutral and actuating positions.

13. The electric switch according to claim 9, wherein the actuating member is spaced from the component.

* * * * *